United States Patent [19]

McGee

[11] Patent Number: 4,771,218

[45] Date of Patent: Sep. 13, 1988

[54] ELECTRICALLY ACTUATED OVERHEAD GARAGE DOOR OPENER WITH SOLENOID ACTUATED LATCHES

[76] Inventor: Michael H. McGee, 4620 Alla Rd., Los Angeles, Calif. 90066

[21] Appl. No.: 36,147

[22] Filed: Apr. 6, 1987

Related U.S. Application Data

[63] Continuation of Ser. No. 760,054, Jul. 29, 1985, abandoned, which is a continuation-in-part of Ser. No. 587,384, Mar. 8, 1984, abandoned.

[51] Int. Cl.[4] ..... E05B 47/00

[52] U.S. Cl. ..... 318/16; 49/280; 49/300

[58] Field of Search ..... 318/16, 466, 467, 468; 49/197, 198, 199, 279, 280, 281, 282, 293, 300, 302, 307, 319; 292/144, 201, DIG. 36, DIG. 41, DIG. 68

[56] References Cited

U.S. PATENT DOCUMENTS

| | | | |
|---|---|---|---|
| 2,770,455 | 11/1956 | Brister | 49/279 X |
| 2,800,348 | 7/1957 | Parsley | 292/DIG. 36 X |
| 2,940,292 | 6/1960 | Heath | 292/144 X |
| 2,971,755 | 2/1961 | Green | 49/280 X |
| 3,154,302 | 10/1964 | Maruyama | 49/280 |
| 3,319,696 | 5/1967 | Wiegand | 49/199 X |
| 3,344,554 | 10/1967 | Misaka et al. | 49/280 |
| 3,429,073 | 2/1969 | Tucker | 49/280 |
| 3,781,622 | 12/1973 | Acton et al. | 318/466 |
| 4,001,661 | 1/1977 | Terabayashi | 318/474 X |
| 4,254,582 | 3/1981 | McGee | 292/DIG. 36 X |
| 4,330,958 | 5/1982 | Richmond | 49/280 |
| 4,549,369 | 10/1985 | Foley, Jr. | 49/279 |
| 4,564,791 | 1/1986 | Brickner | 318/16 |
| 4,668,899 | 5/1987 | Ide et al. | 318/16 X |

*Primary Examiner*—Bentsu Ro

*Attorney, Agent, or Firm*—Freilich, Hornbaker, Rosen & Fernandez

[57] ABSTRACT

A garage door opener with solenoid latches is provided with a circuit for energizing the coils of the solenoid latches with power from a 24-volt step-down transformer, either as 120 volt power is applied to a motor to move the door in response to detection of an initial surge of current or as a manual or radio controlled command switch is actuated. In either case, current at a higher level is applied initially to pull in the armature locking pins of the solenoid latches, and thereafter at a lower hold-in level. A transformer with a single turn primary winding or a Hall-effect device may be used to detect the initial surge of current to the motor and in response thereto pull in the locking pins. Thereafter, hold-in current is applied as long as current to the motor is sensed. In the case of sensing actuation of a command switch, a first one-shot triggered by the command switch times the total period (16 seconds) during which the solenoid latches are provided with at least hold-in current, and a second one-shot triggered by the first one-shot at the beginning of its timing period, times a short (100 ms) period during which high, pull-in current is applied. The second one-shot may also be used to inhibit application of power to the motor during the pull-in time. Still other embodiments utilize a mechanical means for sensing when power has been applied to the motor by the door opener.

10 Claims, 6 Drawing Sheets

ELECTRICALLY ACTUATED OVERHEAD GARAGE DOOR OPENER WITH SOLENOID ACTUATED LATCHES

This application is a continuation of Ser. No. 760,054, filed on July 29, 1985, which is a continuation-in-part of Ser. No. 587,384, filed on Mar. 8, 1984. Both applications are now abandoned.

BACKGROUND OF THE INVENTION

This invention relates to an electrically actuated overhead garage door opener with solenoid actuated latches of the type disclosed in my U.S. Pat. No. 4,254,582.

Automatic garage door openers have now become well established as convenient additions to residences (houses, condominiums and apartments). In addition to the convenience of allowing one to open their garage door by a radio actuated switch, they provide a degree of security for the person and the home, since a garage door controlled by such a system can only be opened from the outside by a coded ratio signal or a key inserted in a lock in the wall adjacent to the door.

As noted in my earlier patent, overhead garage doors are pivotally mounted to move from a closed position upwardly and rearwardly in one flat piece to a nearly horizontal position overhead. For closing, the door is moved pivotally to an upright, nearly vertical position. While an electrical garage door opener attached at the center will hold it in the upright position secure against it being pivotally moved upwardly and rearwardly by an unauthorized person, it may be possible to pry open a corner of the door, particularly of a double car garage, sufficiently to allow a small person to wriggle into the garage. Once in the garage, the person will have access to a pushbutton to open the door, unless the pushbutton is inside the house. But even then, the person may be skillful enough to short leads in the garage door opener to simulate actuation of the pushbutton, or unfasten the garage door from the opener and manually open it.

When the garage is attached to the house or condominium, as is most often the case where electrical garage door openers are used. The person having gained access to the garage with its door closed may then gain access to the home unobserved from the outside. Then after burglarizing the home, the person may open the garage door for a fast exit even though burdened by the possessions being taken. In either the case of an attached or an unattached garage, it would be desirable to provide solenoid actuated latches in the lower corners of the garage doors to prevent a person from wriggling in through a pryed corner.

My earlier patent discloses solenoid actuated latches connected in series with the motor for the garage door opener. When the garage door is to be opened or closed, the electrical door opener provides current at 120 volts ac to the motor. By connecting the coils of the solenoid latches in series with the motor, the solenoid armature is pulled in along the axis of the coil to unlatch the corners of the door whenever the motor of the door opener is running. However, in that arrangement, the coils are necessarily large and expensive. There is also the need of having to wire the latches for 120 volts, and the fact that the high voltage coils consume a significant amount of power. It would be preferable to actuate the solenoids from the door opener with a lower voltage, such as 24 volts.

In order to reduce the power used by the solenoid latches, the initial current used to pull the armatures in should be reduced to just that current necessary to hold them in. Once the garage door reaches its limits, power to the motor is shut off, and the solenoids are de-energized, causing their spring-loaded armatures to pop out and latch the corners of the door in the upright (closed) position. My copending application, Ser. No. 06/587,358, filed Mar. 8, 1984, titled GARAGE DOOR LOCK SYSTEM, discloses a preferred solenoid latch assembly comprised of a box secured to the garage door frame. The latch solenoid is mounted in the box which has two parallel walls with aligned holes through which the solenoid armature or locking pin passes when its coil is not energized. A latch plate mounted on the garage door fits between the parallel walls of the solenoid box with a hole aligned with the holes in the walls of the box to receive the locking pin. The disclosure of that application, as well as my prior patent are incorporated herein by reference.

It is important that the solenoid latches be energized in time to pull the armature locking pins in before the door opener motor has moved the door by any significant amount. Otherwise, the armature locking pins may become jammed between the door plate and the walls of the solenoid box, in which case the garage door will not open, the limit switches of the door opener are not actuated to turn the motor off, and the motor may be damaged before a circuit breaker opens. It is therefore desirable to have a high initial drive current to the solenoid coils once the radio receiver (or pushbutton) switch has been closed, to apply drive current to the motor of the door opener. Thereafter, the solenoid latch current may be reduced to hold the lach armatures in until power has been removed from the motor by the door opener, at which time the de-energized solenoid releases the locking pins to latch the corners of the door.

The system of my earlier patent was designed to be integrated into a garage door opener, at least to the extent that it obtains its operating current from the same current supplied to the automatic garage door opener. The need exists for such a garage door lock system that is powered independently of the electrical garage door opener, and yet is responsive to the garage door opener's operation to appropriately unlatch and latch the lock mechanisms so as to not interfere with the normal operation of the automatic garage door opener, or require disassembly and/or modification of the door opener.

The novel features that are considered characteristic of this invention are set forth with particularity in the appended claims. The invention will best be understood from the following description when read in connection with the accompanying drawings.

FIGS. *7a, b* and *c* illustrate another embodiment utilizing a microswitch for the sensor of a screw-drive door opener where FIG. *7c* is a cross section on a line A—A in FIG. *7a* and FIG. *7b* is an enlarged view of a portion of FIG. *7a*.

FIGS. *8a* and *b* illustrate a variant of the embodiment shown in FIGS. *7a, b* and *c* for a chain-drive door opener, where FIG. *8b* is an enlarged view of a portion of FIG. *8a*.

Figure 9:
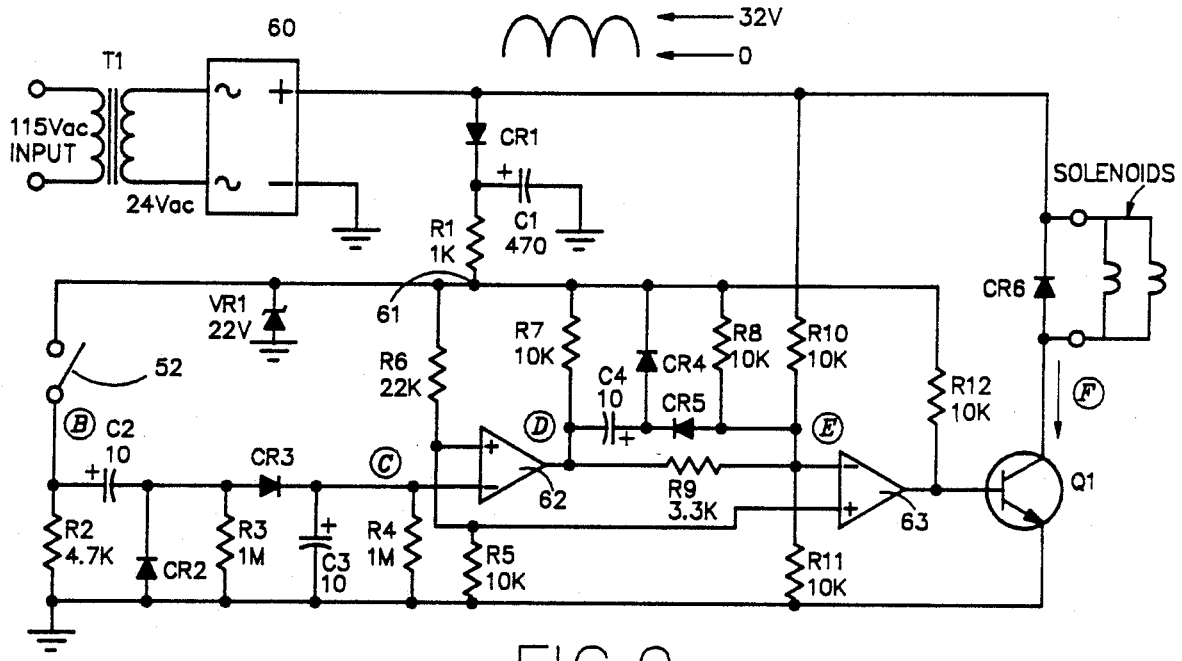

FIG. 9 is a circuit diagram for a control unit of a door opener to be used with the microswitch sensor of FIGS. *7a, b* and *c* or of FIGS. *8a* and *b*.

Figure 10:
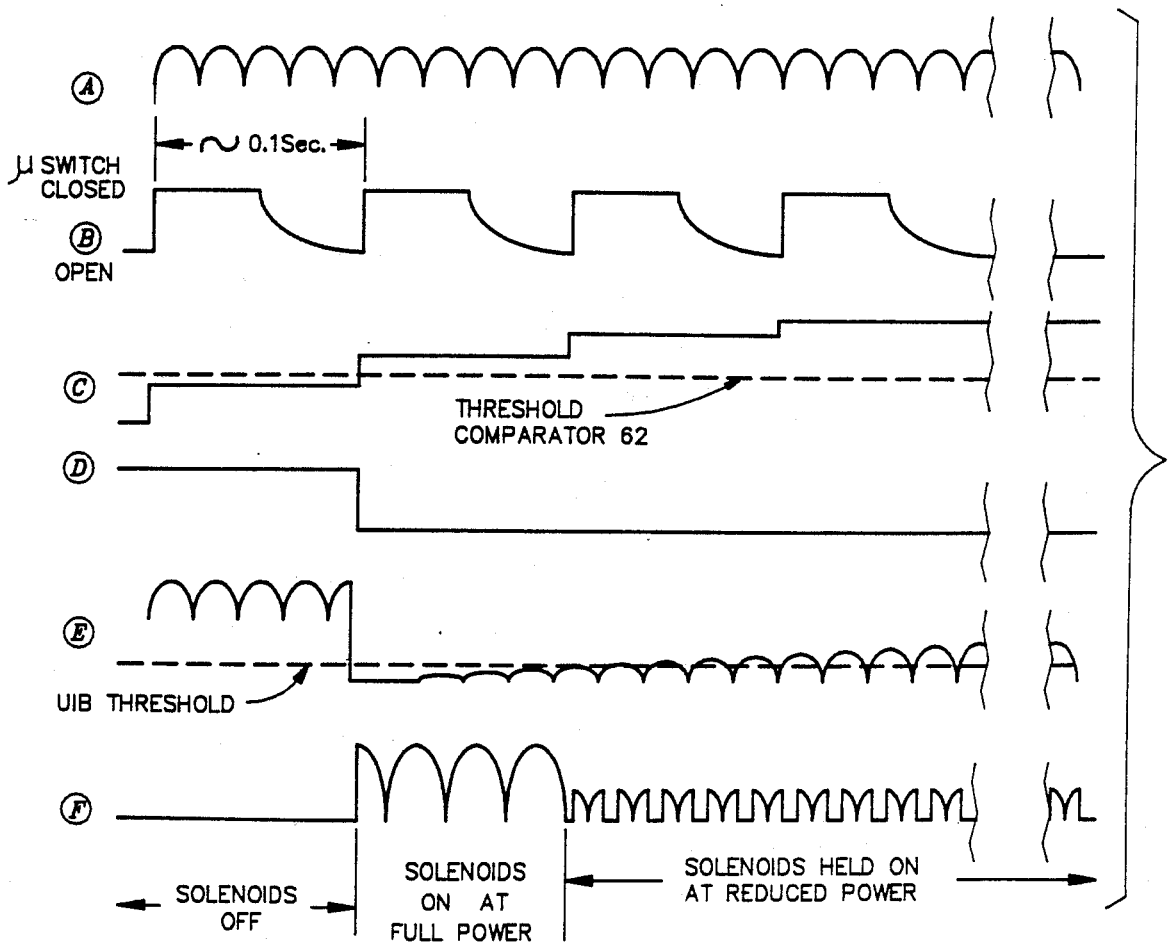

FIG. 10 is a waveform diagram useful in understanding the circuit of FIG. 9.

SUMMARY OF THE INVENTION

In accordance with the present invention, a garage door opener with solenoid latches for locking the lower corners of the door is provided with means for sensing an event related to operation of the garage door opener, and in response to the sensing means energizing the coils of the solenoid latches to pull in the armature locking pins, thereby unlocking the corners of the door before the motor in the garage door opener begins to move the door from its upright, nearly vertical position, upwardly and rearwardly to an overhead, nearly horizontal position.

In one embodiment, the sensing means is a step-up transformer using a power lead from a source of 120 volts at 60 Hertz to the motor as a single turn primary winding. An initial surge of current to the motor is sensed, and the signal thus generated is used to drive power transistors (of the junction of field-effect type) at saturation to energize the coils of the solenoid latches and pull in the armature locking pins. Thereafter, as the motor begins to turn, the sensed current to the motor decreases, and the drive signal to the power transistors decreases to a level sufficient to hold the armature locking pins in. In a second embodiment, a Hall-effect device is used to detect the initial surge of current to the motor, and then the lower level of current delivered by the power transistors to the coils of the solenoid latches in the same manner as in the first embodiment.

In the third embodiment, the event sensed is even earlier than the initial surge of the current to the motor. It is at the closing of a switch, either a pushbutton switch or a radio receiver actuated switch. Closing of either switch triggers a timing one-shot which then drives power transistors that produce a high level of current to the coils of the solenoid coils, and at the same time inhibits operation of the door opener, thereby unlocking the corners of the garage door before power is applied to the motor of the garage opener. Thereafter, a lower level of drive is produced for the power transistors to hold in the armature locking pins for a period sufficient for the door opener to complete its operation. For that purpose a separate one-shot is triggered at the time the first one is triggered. The period of the second is set, for example, at 16 seconds, while the period of the first is set for only a short time sufficient to pull in the armature locking pins, a period of about 100 ms. In practice, the first (100 ms) one-shot is triggered by the leading edge of the output of the second (16 second) one-shot so that while the latter may be repeatedly retriggered before it times out, the former (100 ms) one-shot cannot. In that way, the garage door opener can be operated in the normal manner by a remote radio transmitter or pushbutton.

DESCRIPTION OF PREFERRED EMBODIMENTS

Figure 1:
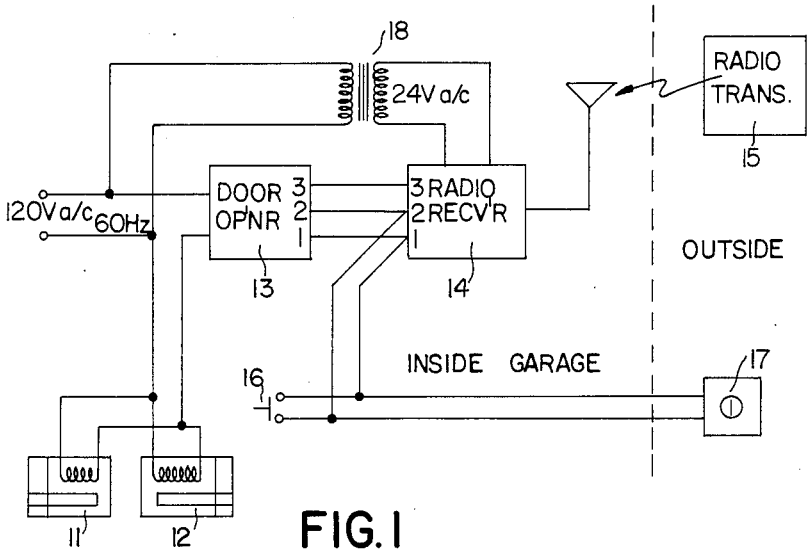
FIG. 1 PRIOR ART
FIG. 1 is a block diagram of the door latch system of my prior U.S. Pat. No. 4,254,582.

Before describing preferred embodiments of the present invention, the system of my prior patent will be described with reference to FIG. 1, which shows two solenoid latches 11 and 12, each having its coil connected in series with a motor in the door opener 13. A radio receiver 14 receives a coded signal from a hand-held radio transmitter 15 to energize a relay in the receiver, or otherwise close a switch (which may be an electronic switch) that operates the door opener. The connection between the receiver and the door opener may be a two-wire or a three-wire connection as shown; in either case a "woodpecker" relay steps a switch in the door opener from off to on, and then from on to off, if the radio transmitter sends another signal, in which case the door is stopped in its partly open position. Triggering the garage door opener a third time will then not only turn on the door opener, but also reverse the direction of the motor. Alternatively, the "woodpecker" relay may step the door opener alternately between forward and reverse each time the aforesaid switch is closed by the radio transmitter, or by a pushbuttom switch 16 inside the garage of residence connected to the receiver by wire. A key operated switch 17 may be similarly connected from outside of the garage. In each case, the receiver operated at low voltage (typically 24 volts) through a step-down transformer 18 will cause 120 volts ac to be applied to the motor via the "woodpecker" switch in the door opener 13. The coil for the "woodpecker" relay is itself operated at low voltage (24 volts ac). The step-down transformer 18 provides the 24 volts needed for that, and a rectifier and filter provides 24 volts dc for the receiver circuits.

As shown, the coils for the solenoid latches 11 and 12 are each connected in series with the motor in the door opener but in parallel with each other. This arrangement reduces the impedance of the two coils in series with the motor, but nevertheless reduces the power available to operate the door opener, particularly since both coils conduct full current at 120 volts ac at all times while the motor is running, which is until the door has been raised or lowered sufficiently to trip a limit switch that cuts off current to the motor; at that time the solenoid latches de-energize and the solenoid locking pins are forced out by a separate spring (not shown) for each. If the door is closed at the time, the pins pass through holes in the two parallel walls of each solenoid latch box and a hole in a separate plate carried by the door on each side that fits between the parallel walls of the solenoid latch boxes, thus latching the corners of the doors.

Other disadvantages of my prior art system, besides power losses in the solenoid coils, are that 120 volt lines must be installed from the garage door opener near the ceiling at the center of the garage to the solenoid latches mounted on each side of the door, and the solenoids must be rated for 120 volts at the amperage of the motor, typically 4.5 amps. The impedance of these solenoid coils will not only affect the power used, but will affect the operation of the motor since some of the start-up power available for the motor is being consumed by the coils.

The present invention overcomes those disadvantages in different embodiments by utilizing a means for sensing when power is to be applied to the door operator so that by the time power is applied to the motor to cause it to turn, a control unit will have pulled in the solenoid locking pins.

A first embodiment will now be described with reference to FIG. 2. A door opener 20 is shown with a receiver 21 having a remote pushbutton switch 22*a*, as in the prior art system. It may also have a keyswitch 22*b*. The door opener may have a 2- or 3-wire connection with the receiver. In either case, the door opener will function in its usual manner in response to a switch being closed in the receiver 21 by a hand held radio transmitter 23, or the pushbutton switch 22. Once current is applied to the motor, there is an initial surge that is detected by a sensor 24. That signal may be threshold detected in a control unit 25 which drives the coils of solenoid latches 26 and 27. An amplifier in the control unit may be biased to operate at saturation during this initial surge condition, thereby to pull in the armature locking pins of the solenoid latches. thereafter, as the motor begins to run, the line current will subside, causing the control unit amplifier to operate at some point below saturation just sufficient to hold the armatures of the solenoid coils in against the force of bias springs. The control unit 25 is shown powered by 24 volts ac from a separate step-down transformer 28 which delivers 24 volts ac to the radio receiver, but in practice may be powered from a 24 volt step-down transformer in the door opener 20.

Because of the inertia of the motor, and slack in the mechanical system for opening the door, there is a natural delay between the time the receiver 21 closes a switch in the door opener 20 and the time the motor in the door opener begins to actually lift the door from its locked position. This delay is more than 100 ms, which is time enough to pull in the armature locking pins, so that as the door begins to move, the pins have cleared the locking plates on the garage door (not shown) which fit between parallel walls of the solenoid latch box.

Figure 3A:
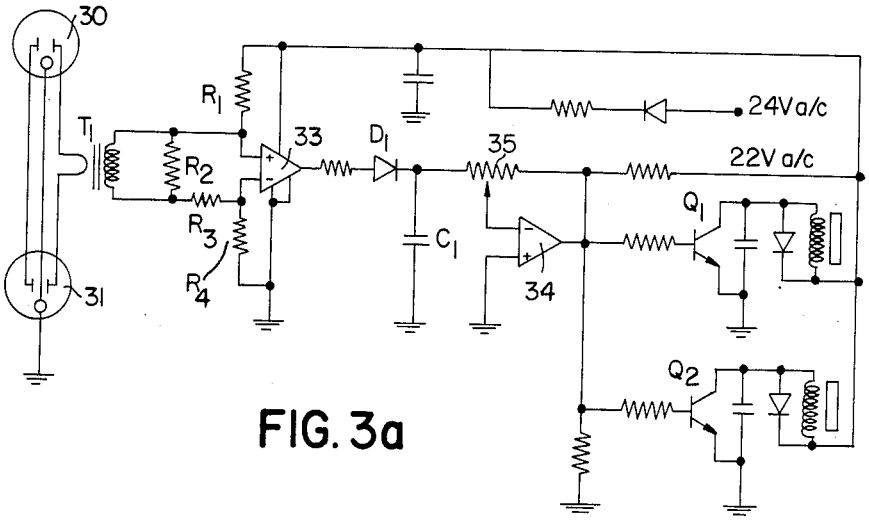
FIG. 3*a* is a circuit diagram of a motor current sensing embodiment of the present invention.
Figure 3B:
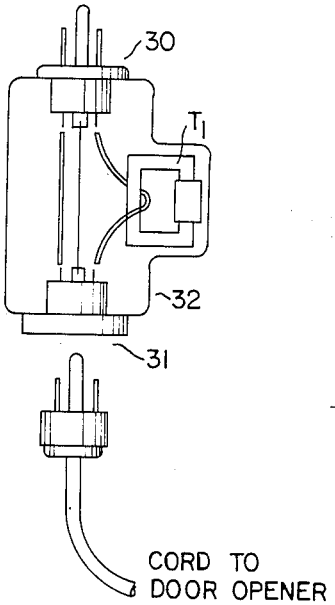
FIG. 3*b* is a schematic diagram of a current-sensing plug-in unit for the circuit of FIG. 3*a*.

A preferred embodiment of the concept is disclosed in FIGS. 3*a* and 3*b*, wherein a single-turn step-up transformer $T_1$ is connected with its primary winding between a male ac input 30 and a female ac output 31 of a plastic plug housing 32. The power cord of the door opener is plugged into the female ac output 31, while the male ac input 30 is plugged into a wall socket in the garage.

Figure 3C:
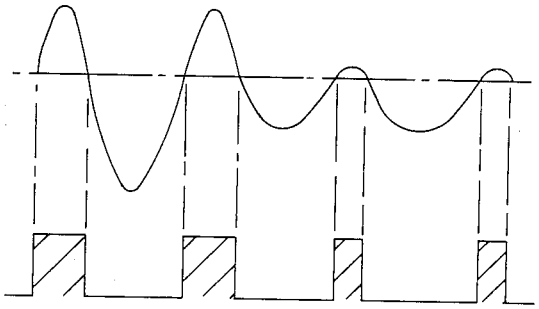
FIG. 3*c* illustrates waveforms for facilitating the operation of the circuit of FIG. 3*a*.

A first operational amplifier 33 (FIG. 3*a*) is biased by resistors $R_1$–$R_4$ to conduct at such a level that it will turn off with the negative half cycles of the 24 volt ac on the secondary of the transformer $T_1$ over less than about 60 degrees centered on the negative half cycles under normal conditions. The higher amplitude surge of current during the initial period of about 100 ms will then cut off the amplifier 33 over more than 60 degrees, and very nearly 180 degrees, thereby producing an almost symmetrical squarewave, as shown in FIG. 3*c*, until the surge subsides, at which time the amplifier 33 will be cut off, except over shorter periods approaching about 60 degrees, as shown in FIG. 3*c*.

The output of the amplifier 33 drives an inverting buffer amplifier 34 via a rectifying diode $D_1$ and filter capacitor $C_1$ to produce a positive signal to transistors $Q_1$ and $Q_2$, shown as n-p-n junction transistors, although in practice field-effect transistors may be used for greater stability under varying temperature and voltage conditions. Alternatively, the power transistors may be provided with temperature and voltage compensation circuitry. It may thus be readily appreciated that during the inital surge of current to the motor of the door opener, the current sensor comprised of transformer $T_1$ will product a squarewave output from the differential amplifier 34 for maximum drive of the transistors $Q_1$ and $Q_2$. Then as the squarewave output gives way to narrower pulses, the drive current of the base-emitter junctions of the transistors $Q_1$ and $Q_2$ will diminish, but the current to the coils of the solenoids will then still be sufficient to hold in the armature locking pins. A potentiometer 35 in the feedback of the operational amplifier 34 allows the gain of that amplifier to be adjusted for adequate hold-in current to the solenoids.

Figure 4:
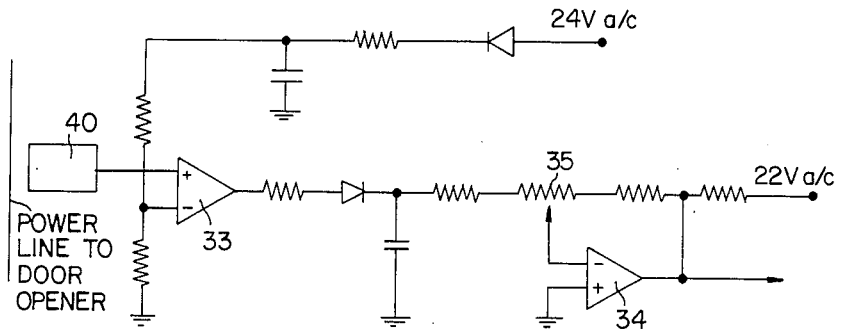
FIG. 4 is a circuit diagram of an alternative current sensing embodiment of the invention.

FIG. 4 illustrates a second embodiment which utilizes a linear Hall-effect (magnetic field) sensor 40 of, for example, either type TL173I or TL173C available from Texas Instruments, Inc. for sensing current to the motor of the door opener in place of the transformer $T_1$ in the embodiment of FIG. 3*a*. Otherwise the organization and operation of the system is the same as in the embodiment of FIG. 3*a*. The Hall-effect sensor provides an output current proportional to the magnetic field sensed, i.e., proportional to the current through the power line to the ac motor of the door opener. Included in the package for the Hall-effect device is a monolithic circuit which incorporates the Hall-effect element as the primary sensor along with a voltage reference and a precision amplifier, as well as temperature stabilization and timing circuitry. The TL173I is accurate to within 5% over its operating temperature range of −20 degrees C. to 85 degrees C. The TL173C has a similar accuracy over a range of 0 degrees C. to 70 degrees C.

Figure 5:
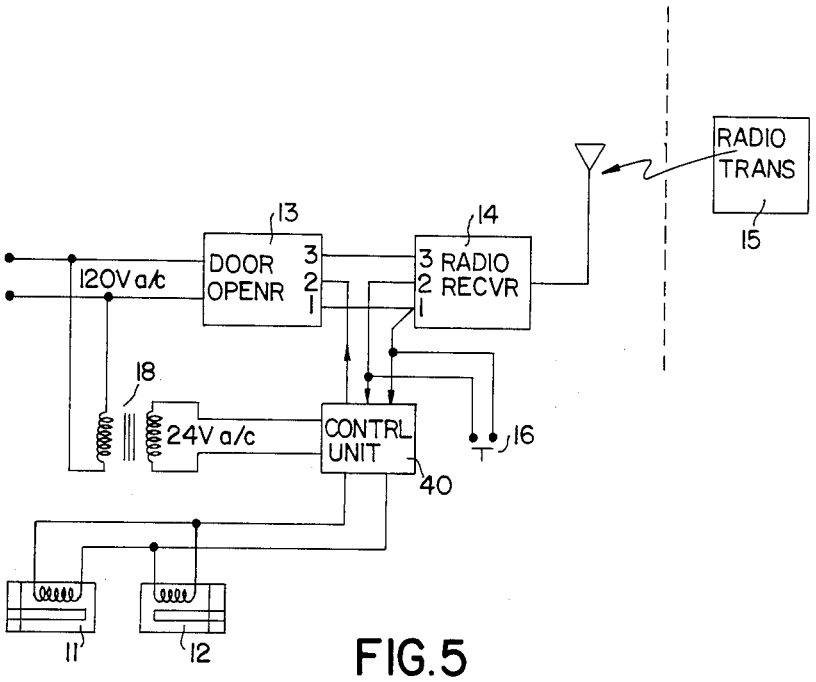
FIG. 5 is a block diagram of another motor current interrupt embodiment.

FIG. 5 illustrates a variant of the present invention in which the sensing means does not directly sense current to the motor, but instead senses the radio transmitted signal, or the closing of the pushbutton 16, and interrupts operation of the door opener for 100 ms while the solenoid latches 11 and 12 are energized to pull in their armature locking pins. After that the motor is turned on and the power to the solenoid latches is reduced to a holding level. This is accomplished by a control unit 40 shown in FIG. 5 which receives 24 volts ac from the transformer 18 and delivers power to the solenoids 11 and 12 at 24 volts as will be described.

To interrupt power to the motor of the door opener 13 for 100 ms, the control unit 40 is connected between the receiver 14 and the door opener 13. The control unit then responds to the radio or pushbutton signal received and initiates the 100 ms timing during which the radio or pushbutton signal is not transmitted to the door opener. Instead, full 24 volts dc power is applied to the coils of the solenoid latches 11 and 12. At the end of that period, the power to the solenoid latches is reduced and the radio or pushbutton switch signal is relayed to the door opener so that it will operate in the usual manner after a positive delay of 100 ms. An exemplary circuit for the control unit 40 will now be described.

Figure 6:
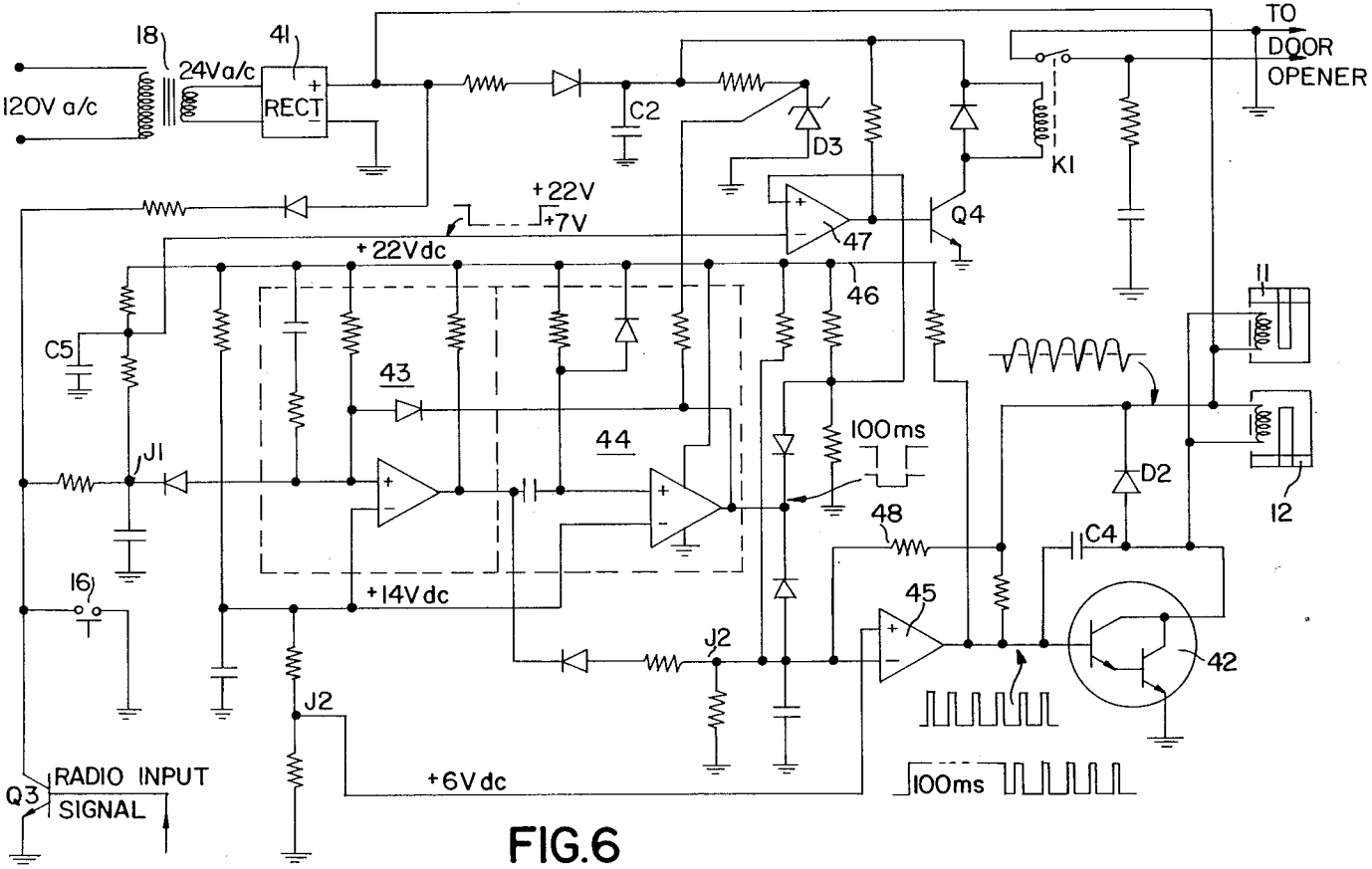
FIG. 6 is a circuit diagram of the embodiment of FIG. 5.

Referring to FIG. 6, the control unit 40 of FIG. 5 is shown connected at the top to receive 24 volts ac from the transformer 18 at the upper left corner and the radio and pushbutton signal at the lower left corner. The power to the solenoid latches is delivered from a full-wave rectifier 41 through a Darlington pair 42 of n-p-n transistors in response to the radio or pushbutton signal vi a 16-second one-shot 43 and a 100-millisecond one-shot 44 triggered on the leading edge of the 16-second pulse output from the one-shot 43.

The 100-ms negative pulse out of the one-shot 44 is applied to a comparator 45 which has a 6 volt dc reference at its noninverting (positive) input. The 100-ms pulse drives the inverting input of the comparator 45 below the 6 volt reference so that it is inverted and applied to the Darlington pair 42 to turn the transistors on to saturation. This enables all of the full-wave rectified power from the rectifier 41 to flow through the coils of the solenoid latches 11 and 12. A diode $D_2$ is reverse biased during this time, and will become forwrd biased when the Darlington pair is turned off so that power stored in the coils will not damage the transistors, as is common practice in switching power on and off to an inductive load.

The full-wave rectifier 41 is followed by a filter comprising capacitor $C_2$ and a Zener diode $D_3$ to provide a regulated +22 volts dc on a bus 46 which biases the inverting input terminal of a comparator 47 at +22 volts dc, until a radio or pushbutton signal is received to trigger the 16-sec one-shot 43, and in turn the 100-ms one-shot 44. This signal drops the reference voltage to the inverting input terminal of comparator 47 to +7 volts dc. While the inverting input terminal of the comparator 47 is at +7 volts dc, and the non-inverting input terminal is below +7 volts dc for a period of 100 ms set by the one-shot 44, the comparator 47 will prevent conduction of transistor $Q_4$. Once the 100-ms period expires, the noninverting input terminal will rise to about +11 volts dc to turn on the comparator 47 which then turns on transistor $Q_4$ to energize a normally open relay $K_1$. Closing this relay actuates the door opener 13 (not shown in FIG. 6), i.e., performs the function of the pushbutton switch 16 (or the transistor switch $Q_3$ shown in FIG. 6), but only after a 100-ms delay to allow time for the solenoid latches to be energized.

Once the solenoid latches 11 and 12 are energized and the door opener is turned on (i.e., power is applied to its motor) at the end of the 100-ms pulse from the one-shot 44, the inverting input of comparator 45 becomes positive, dropping the output of the comparator 45 and thereby turning off the Darlington pair 42. However, the 24 volts ac output of the rectifier applies bias to the input of the comparator 45 via resistor 48 and periodically drives the inverting input of the comparator 45 below the bias level of 6 volts dc at junction $J_2$. When it reaches a level below the reference level of +6 volts dc at the junction $J_2$, the output of the comparator 45 becomes positive to drive the Darlington pair at saturation. This will occur for a short period of 8.3 ms when the full-wave output of the rectifier 41 drops to near zero, i.e., between every full-wave rectified half cycle of the 24 volts ac input at 60 hertz. The result is a lower level of power energizing the solenoid latches once their armature locking pins are pulled in. A feedback capacitor $C_4$ functions as a filter capacitor for the pulsed output to the solenoid coils. Thus, by sensing that power is to be applied to the door opener motor, and interrupting the operation of power for 100-ms while the solenoid latches are energized in response to that sensing, there is positive assurance that the armature locking pins will be pulled in before the motor begins to move the garage door. The 16-second one shot allows sufficient time for the door to be fully opened or closed before the 100-ms one-shot 44 can again be triggered.

If, during the 16 second timing period of the one-shot 43, the junction $J_1$ is again pulled down to pull the inverting input of the comparator 47 down to +7 volts dc, the one-shot 43 will be retriggered to reinitiate the timing period of 16-seconds, but the 100-ms one-shot is not retriggered to inhibit the comparator 47. As a consequence, a second radio or pushbutton signal during a 16-second interval will reinitiate the 16 second timing period and energize the relay $K_1$ to stop the door opener motor, or reverse its direction, just as though this control unit were not connected between the receiver and the door opener.

Figure 2:
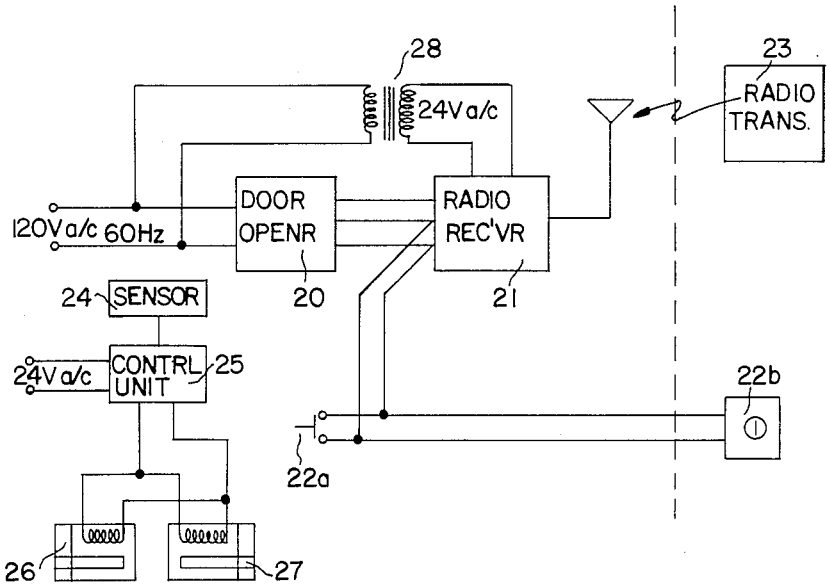
FIG. 2 is a block diagram of the present invention.

Operation of a preferred circuit for implementing this third embodiment having thus been described, it should be apparent that the sensing means referred to in FIG. 2 senses an event associated with applying power as in the first two embodiments, but instead of relying on mechanical delay in the door actually being initially moved once the motor is energized to pull in the solenoid armature locking pins, the sensing means introduces a 100-ms delay before even energizing the relay $K_1$, which in turn energizes the "woodpecker" or other relay in the door opener to apply power to the motor for rotation in the correct direction, but the delay is introduced only at the beginning of the first 16-second timing period. If the 16-second one-shot is retriggered to reset (reinitialize) timing before the period runs out, the "woodpecker" or other relay in the door opener is actuated immediately, without a 100-ms delay, to stop or reverse the motor. Throughout the 16-second period, holding power is applied to the solenoid latches. That is more than ample time for the door to be moved from its fully closed or opened position to its fully opened or closed position. If moved to the closed position, the armature locking pins will be released, and springs in the latch boxes will move them into locking position. If moved to the open position, the armature locking pins are also released, but they do not, of course, lock at that position as there would be no need; the door simply rests in the horizontal position.

Figure 7A:
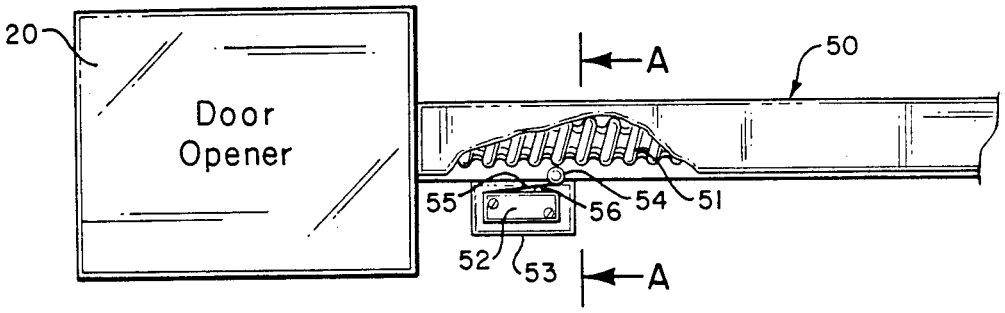
Figure 7B:
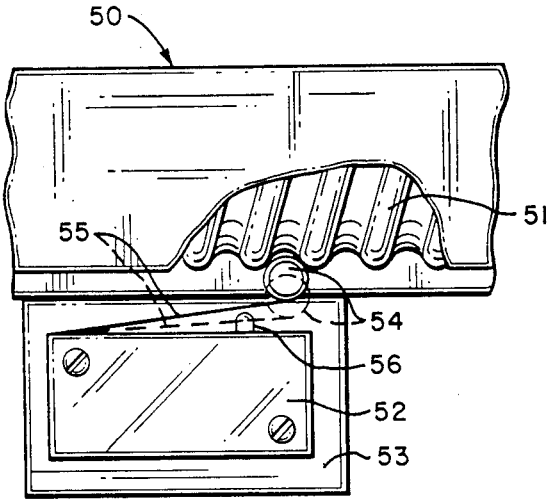
Figure 7C:
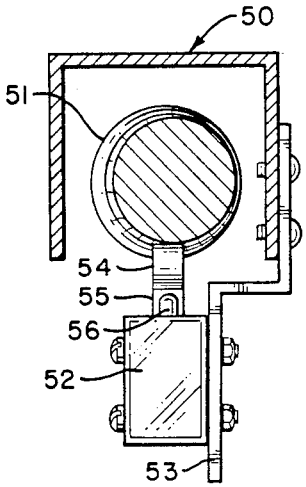

Other embodiments utilize a mechanical sensor for operation of the control unit 25. Briefly, the garage door opener operates as described with reference to FIG. 2, but the sensor is comprised of a microswitch that opens and closes approximately every 0.1 second once the motor in the door opener is activated. FIGS. 7*a, b* and *c* illustrate one arrangement for utilizing a microswitch for the sensor 24 in a door opener operating with a screw-drive mechanism 50. Basically, the mechanism is a worm gear 51 turned by a motor in the door opener 20. A carriage (not shown) moves toward or away from the door opener 20, depending on the direction of rotation of the motor in the door opener. A microswitch 52 mounted on a bracket 53 has a follower 54 at the end of an arm 55 which rides over the worm gear. As the worm gear turns, the follower 54 moves up and down to pivot the arm 55 against a microswitch plunger 56. The control unit 25 (FIG. 2) will energize the solenoid latches 26, 27 (FIG. 2) to retract the lock pins when two consecutive actuations of the microswitch occur from open to close to open, or from close to open to close. Once the lock pins are retracted, continuous actuation of the microswitch produces a signal which causes the control unit to continue to keep the solenid latches actuated.

Figure 8A:
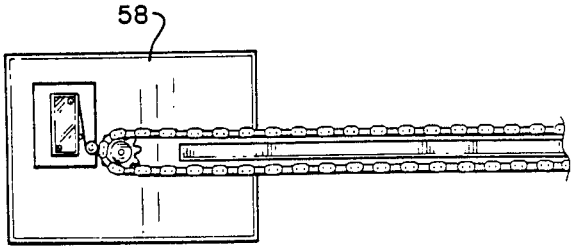
Figure 8B:
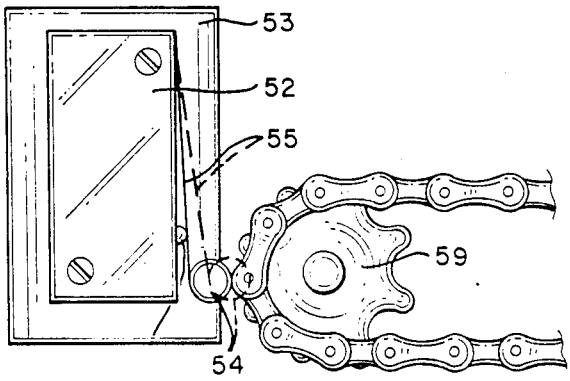

In the case of a chain drive mechanism shown in FIGS. 8*a* and *b*, the microswitch is mounted on the door opener housing 58 next to a drive sprocket 59. The microswitch follower 54 of the embodiment just described above will ride over the chain links to pivot the microswitch arm 55 against the microswitch plunger 56. The plunger of the microswitch is spring biased in the out (open) condition. The relatively rigid arm 55 forces the plunger in against the spring as the follower 54 rides over a chain link to momentarily close the microswitch.

In either a worm gear or chain drive mechanism, the control unit 25 includes a circuit shown in FIG. 9 which is responsive to the microswitch 52 for delivering full power to the solenoid latches for about 50-ms after the switch opens and closes, or closes and opens, to pull the lock pins in quickly. Then, so long as the switch continues to open and close, and for a few seconds thereafter, the circuit of the control unit delivers power at a lower level sufficient to hold the lock pins in the retracted position to ensure that the door has come to rest either up or down before releasing the spring loaded pins.

Referring now to FIG. 9, the circuit of the control unit 25 for this mechanical sensor is powered from an ac transformer $T_1$, followed by a full-wave rectifier 60 which produces a 32 volt rectified ac waveform A shown in FIG. 10 to power the solenoid latches. For convenience the points at which the waveforms of FIG. 10 are taken have been indicated in the circuit diagram of FIG. 9. Diode $CR_1$, capacitor $C_1$, resistor $R_1$ and Zener diode $VR_1$ produce 22 volts dc at junction 61 to operate the control circuit.

Microswitch 52 may be either open or closed when the mechanism is at rest, but as the mechanism begins to move, it opens and closes alternately at a rate of several times per second as represented by waveform B of FIG. 10. The opening and closing of the switch alternately charges and discharges capacitor $C_2$ to produce the waveform B in FIG. 10 which in turn charges capacitor $C_3$ through diode $CR_3$, as shown in waveform C. As this voltage at the input of comparator 62 rises above the threshold voltage at the noninverting input of the comparator after just two closures of the microswitch, the output of the comparator 62 (waveform D) drops to ground and remains in that state until motion stops and the charge of capacitor $C_3$ decays through resistor $R_4$. Thus, the RC time constant of charge and times of the capacitors $C_2$ and $C_3$ assure that the output of the comparator 62 will not switch state from high to low until the switch has been closed twice within about 0.1 second. If the switch is initially open when the door opener is at rest, the RC timing begins when the switch is closed; otherwise the RC timing begins when the switch is opened and then closed again. In either case the capacitor $C_2$ couples a second charge within about 0.1 second to the capacitor $C_3$ which is added to the charge stored on the capacitor $C_3$ to exceed the threshold for the comparator 62 set by resistor $R_5$ and RC between junction 61 and circuit ground. The capacitor will discharge through resistor $R_4$ at a rate sufficiently slow to enable the capacitor $C_3$ to charge from zero to above threshold by just two closures of the switch 52. Capacitor $C_2$ will charge very quickly when the switch is closed, and discharge fully throgh resistor $R_2$ during the interval switch 52 is open. For that reason, resistor $R_2$ is 4.7 k as compared to resistors $R_3$ and $R_4$, which are 1 Megohm. Diodes $CR_2$ and $CR_3$ function as automatic commutating switches for transfer of the charge on capacitor $C_2$ to the charge stored in capacitor $C_3$.

When the voltage at the output of the comparator 62 drops, the capacitor $C_4$ drives the inverting input of comparator 63 to ground, forcing the output of comparator 63 to the high (off) state which allows resistor $R_{12}$ to turn transistor $Q_1$ on. This places the full-wave rectified voltage of waveform A across the solenoids, driving them at full power to pull the locking pins in quickly.

As capacitor $C_4$ charges, the waveform E rises such that this voltage, which is applied to the inverting input terminal of comparator 63, falls below the threshold (reference voltage) at the noninverting input terminal of comparator 63 only during the lower voltage levels of the rectified sine wave (waveform A) through resistors $R_{10}$, $R_{11}$, etc. The result is that transistor $Q_1$ is conducting only during the end and beginning of each half cycle of the waveform, as shown in waveform F. Hence, the power applied to the solenoids is reduced after an interval required to charge the capacitor $C_4$ to avoid heating of the transistor and solenoids but yet hold the solenoids in their energized condition. This condition persists as long as motion of the gear or chain drive continues to open and close switch 52, since this keeps capacitor $C_3$ charged via the "pumping" action of capacitor $C_2$. When the comparator 62 switches back to a high level at its output, the comparator 63 will have its inverting input terminal once again biased so that it will not conduct at all during each half cycle of the full wave rectified ac. Transistor $Q_1$ will then be shut off and the solenoids de-energized.

Thus, when motion stops, the charge of capacitor $C_3$ decays through resistor $R_4$. As the voltage at the inverting input terminal of the comparator 62 drops below the threshold voltage at the non-inverting input terminal, the output of comparator 62 rises, which causes comparator 63 to revert to its original state and shut off transistor $Q_1$.

Although particular embodiments of the invention have been described and illustrated herein, it is recognized that modifications and variations may readily occur to those skilled in the art. Consequently, it is intended that the claims be interpreted to cover such modifications and variations.

What is claimed is:

1. In a garage door opener having an electric drive means for opening and closing said garage door on command, including a motor for moving said garage door, an improvement comprising at least one electrically actuated lock for locking said garage door while closed, said lock being mechanically and electrically seprate from said drive means, means for sensing one event related to said command for operation of said garage door opener in response to a switch that is closed to command door opener operation, means for sensing another event, said another event being related to operation of said motor and produced as a result of said one event prior to movement of said door by said motor, and means responsive to said one event sensing means for actuating said lock to unlock said door before said motor begins to move said door.

2. A garage door opener as defined in claim 1 wherein said another event sensing means comprises means for detecting an initial surge of current to said motor and for thereafter detecting a lower level of drive current to said motor, said lock including a solenoid latch having a coil and an armature serving as a locking pin, and said another event sensing means applying a level of current to said coils of said solenoid latch sufficient to pull in said locking armature while said surge current is being detected, and thereafter for applying a lower level of current to said coil sufficient to hold in said armature while said lower level of drive current to said motor is being detected.

3. A garage door opener as defined in claim 2 wherein said motor is an ac motor, and said detecting means is comprised of a transformer having a single-turn primary winding connected in series with said ac motor and a multi-turn secondary winding, and said garage door opener having means for causing said transformer to conduct 120 volt power to said ac motor through said primary winding in response to said switch that is closed to command door opener operation.

4. A garage door opener as defined in claim 2 wherein said motor is an ac motor, and said detecting means is comprised of a Hall-effect device positioned adjacent to a power lead of said ac motor for sensing a current surge when door opener operation is commenced.

5. A garage door opener as defined in claim 1 wherein said lock includes a solenoid latch having a coil and an armature serving as a locking pin, and said another event sensing means is comprised of a first one-shot for timing a period sufficient for the garage door to be moved from the fully opened or closed position to the fully closed or opened position by the closure of said switch, and a second one-shot triggered by the first one-shot in response to said first one-shot being triggered, and means responsive to said second one-shot for energizing said coil with a first level of current sufficient to pull in said armature until said second one-shot times out and thereafter with a second lower level of current sufficient to hold in said armature until said first one-shot times out.

6. A garage door opener as defined in claim 5 including means responsive to said second one-shot for delaying operation of said garage door opener until said second one-shot times out.

7. In a garage door opener with at least one solenoid latch for locking a garage door while closed, said solenid latch having a coil and an armature, and said door opener having an electric motor for moving the garage door, an improvement comprising means for sensing a mechanical event, said mechanical event being related to operation of said garage door opener, and means responsive to said sensing means for initially controlling energizing current available to the coil of said solenid latch to a first level of current to pull in said armature when initial mechanical operation of said garage door opener is sensed thereby unlocking the door before said door opener begins to move said door, and thereafter controlling the energizing of said coil with a second, lower level of current as long as continued operation of said garage door opener is sensed.

8. A garage door opener as defined in claim 7 wherein said sensing means comprises a microswitch, means operated by a drive mechanism for opening and closing said microswitch as said mechanism moves to open or close said garage door, a source of dc voltage, a storage capacitor and circuit means for adding a predetermined charge from said source to a charge stored in said capacitor, a resistor in parallel with said capacitor for discharging the charge stored therein at a rate less than the rate at which charges are added, and threshold means responsive to the sum of two initial predetermined charges added in said storage capacitor for energizing said coils.

9. In combination, a garage door opener with electric door locks, said combination comprising means for sensing an event related to operation of said garage door opener which enables said electric locks to work in conjunction with said garage door opener before said garage door opener begins to operate, and delay means responsive to said sensing means for limiting the electric power supplied to said locks after unlocking of said locks and when said garage door opener is operational.

10. The apparatus of claim 9 wherein said garage door opener is supplied by electric power and said sensing means is coupled to the source of electric power supplied to said garage door opener, said sensing means being activated when said garage door opener draws power from said source of electric power.

* * * * *